US005268659A

United States Patent [19]

Zaki et al.

[11] Patent Number: 5,268,659

[45] Date of Patent: Dec. 7, 1993

[54] COUPLING FOR DUAL-MODE RESONATORS AND WAVEGUIDE FILTER

[75] Inventors: Kawthar A. Zaki, Potomac; Seng-Woon Chen, Silver Spring, both of Md.

[73] Assignee: University of Maryland, College Park, Md.

[21] Appl. No.: 692,549

[22] Filed: Apr. 29, 1991

[51] Int. Cl.[5] ..... H01P 1/208

[52] U.S. Cl. ..... 333/209; 333/212

[58] Field of Search ..... 333/21 R, 21 A, 24.3, 333/202, 208-212, 227, 228, 230

[56] References Cited

U.S. PATENT DOCUMENTS

| | | | |
|---|---|---|---|
| 4,291,287 | 9/1981 | Young et al. | 333/210 |
| 4,513,264 | 4/1985 | Dorey et al. | 333/209 X |
| 4,675,631 | 6/1987 | Waggett | 333/210 |
| 4,721,933 | 1/1988 | Schwartz et al. | 333/212 |

OTHER PUBLICATIONS

Zaki et al., "Canonical Longitudinal Dual-mode . . . without Iris", IEEE Trans. on Microwave Theory & Tech. vol. MTT-35, No. 12, Dec. 1987, pp. 1130-1135.

William et al., "Dual-Mode Canonical Waveguide Filters", IEEE Trans. on Microwave Theory & Tech vol. MTT-25, No. 12, Dec. 1977, pp. 1021-1026.

Atia et al., "Narrow-Bandpass Waveguide Filters", IEEE Trans. On Microwave Theory & Tech. vol. MTT-20, No. 4, Apr. 1972, pp. 259-263.

*Primary Examiner*—Paul M. Dzierzynski
*Assistant Examiner*—Seung Ham
*Attorney, Agent, or Firm*—H. C. Lin

[57] ABSTRACT

Dual-mode resonators are coupled together to form a highly selective bandpass filter by means of a short section of waveguide. The short sections have cutoff frequencies beyond the passband of the filter. The coupling is adjustable over a wide range by means of adjustable screws. The coupling means is applicable to both empty cavities and dielectric-resonator-loaded cavities.

12 Claims, 5 Drawing Sheets

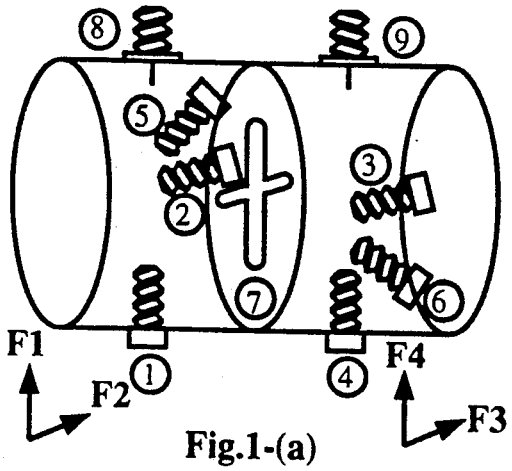
Fig.1-(a)
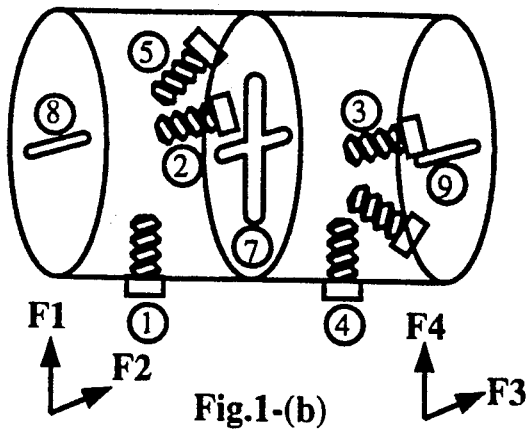
Fig.1-(b)
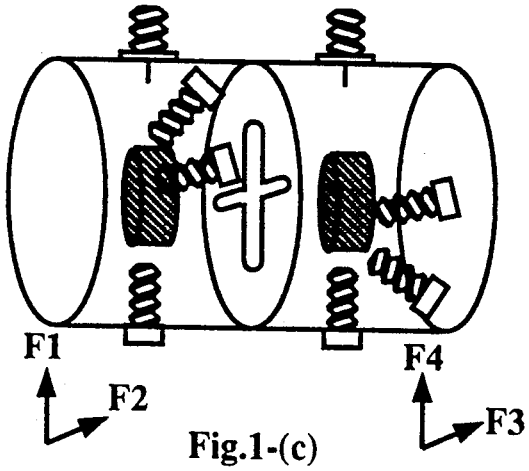
Fig.1-(c)
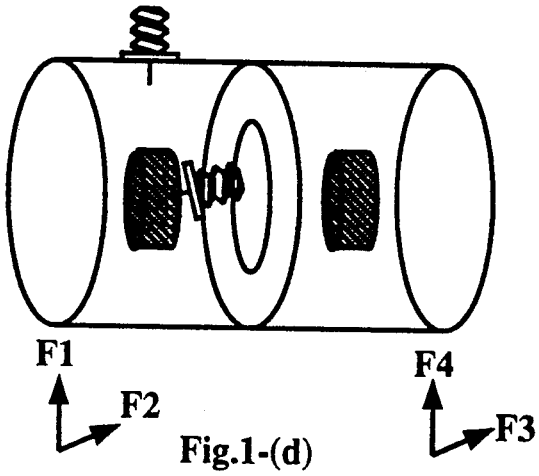
Fig.1-(d)
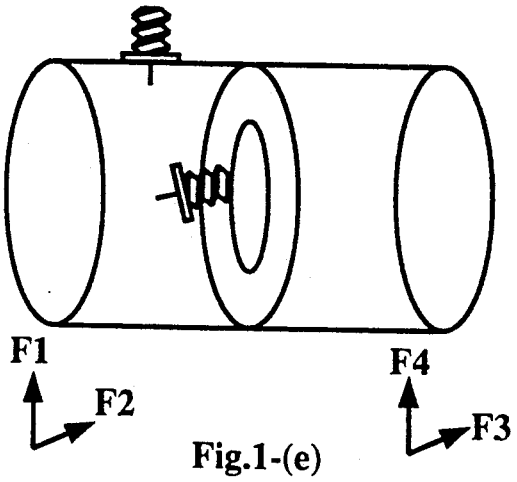
Fig.1-(e)
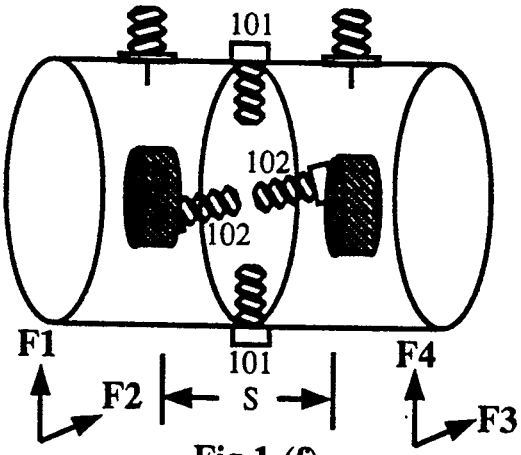
Fig.1-(f)
Prior Art

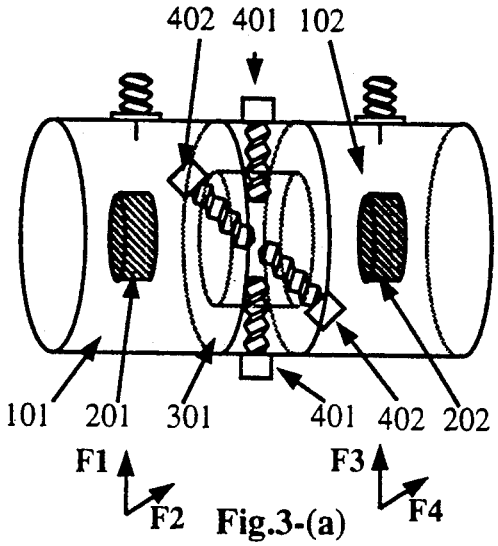
Fig.3-(a)
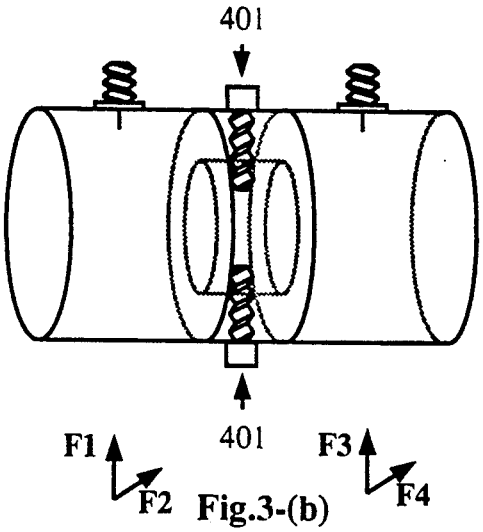
Fig.3-(b)
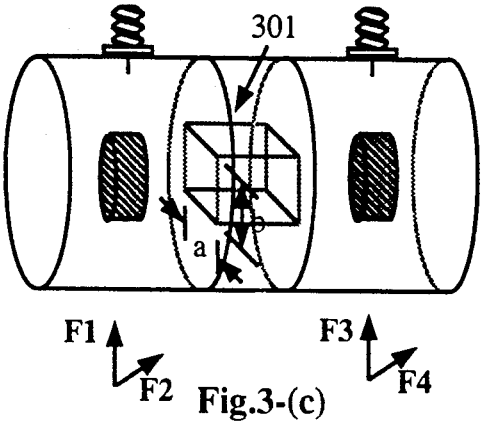
Fig.3-(c)
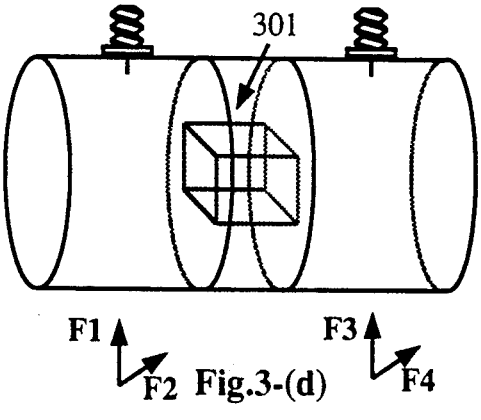
Fig.3-(d)
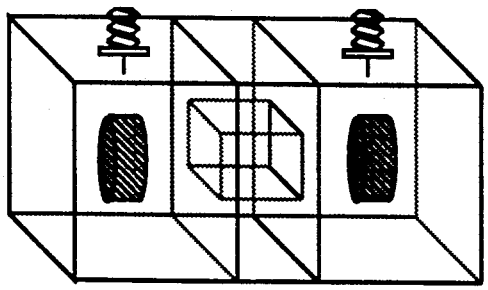
Fig.3-(e)
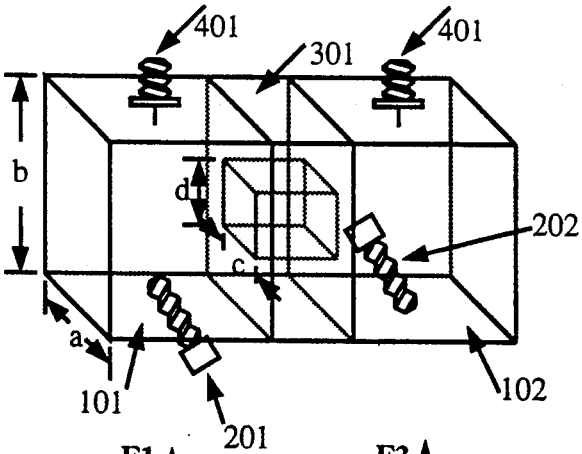
Fig.3-(f)

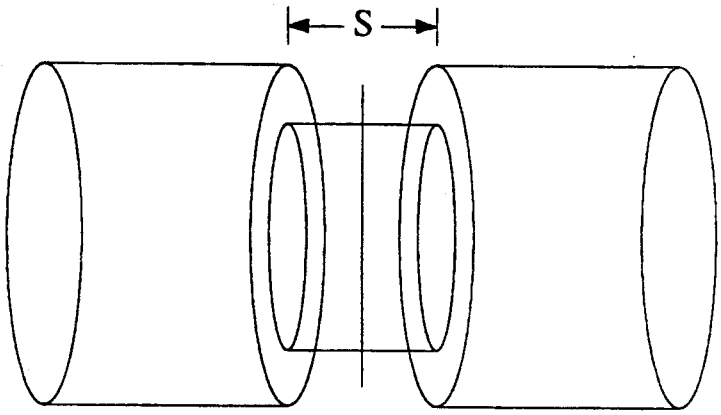
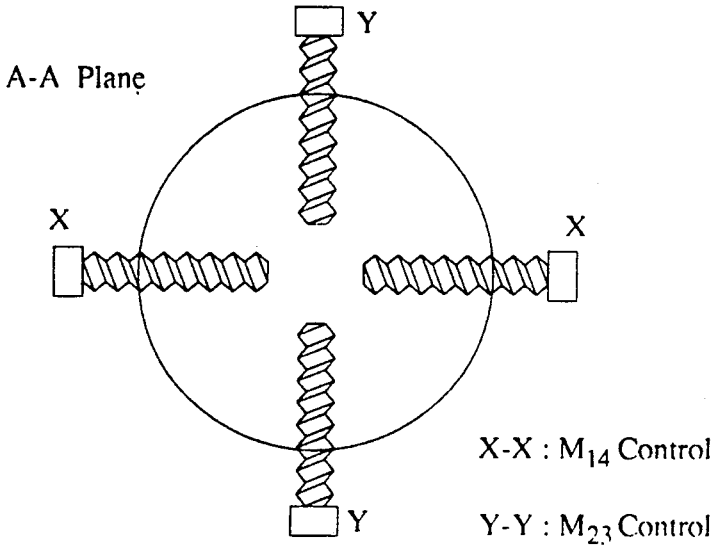
Fig.4 (a)
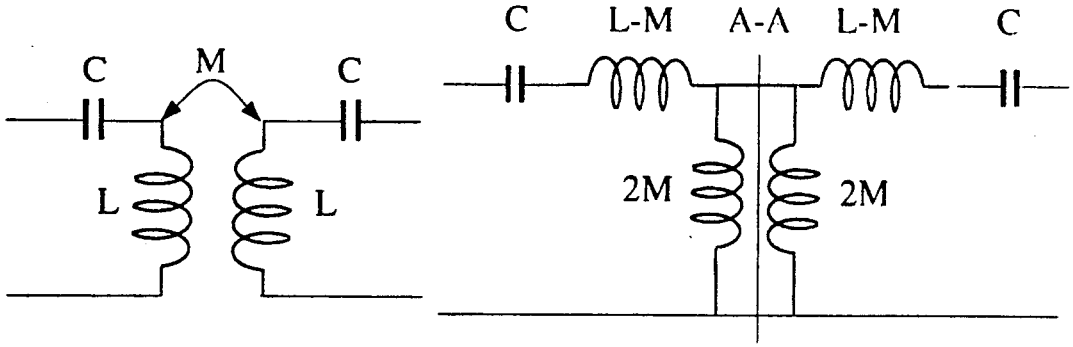
Fig.4 (b)

COUPLING FOR DUAL-MODE RESONATORS AND WAVEGUIDE FILTER

BACKGROUND

This invention is related to microwave bandpass filters. In the design of bandpass filters, it is a common practice to couple a number of resonant sections to increase the selectivity of the filter. In microwave applications, the resonant sections are in the form of waveguides or dielectric resonators.

The dual-mode filter is a class of filters, in which the signal is excited in two orthogonal modes, as described by Atia and Williams in an article, "Narrow Bandpass Waveguide Filters" published in IEEE Transactions on Microwave Theory and Techniques, Vol.MTT-20, pages 258–265, April, 1972; and in another article "Dual Mode Canonical Waveguide Filter", published in IEEE Transactions on Microwave Theory and Techniques, Vol. MTT-25, pages 1021–1026, December 1977. The descriptions can also be found in U.S. Pat. Nos. 3,697,898, "Plural Cavity Bandpass Waveguide Filter", and 4,060,779, "Canonical Dual Mode Filter". This type of filter offers significant performance, size and mass advantages over conventional direct coupled cavity filters, in that the number of required resonant sections are reduced for the same selectivity.

These filters, however, require cross irises to provide couplings between resonators. Two factors make the use of irises difficult and expensive. First, the dimensions of the irises are determined on the basis of a small-aperture approximation, which is not accurate if the dimensions (i.e. width and length of the slot) are comparable to the operating wavelength. Therefore, trimming of the irises is inevitable in the course of tuning and testing. Second, the irises have to be produced (machined and silver-plated) to a high degree of precision which contribute significantly to the high cost of producing the filters.

Recently, realizations are introduced of canonical and longitudinal dual-mode dielectric resonator filters without irises, as described by Zaki et. al. in the paper, "Canonical and longitudinal dual mode dielectric resonator filters without irises", published in the IEEE Transactions on Microwave Theory and Techniques, Vol.MTT-35, pp. 1130–1135, December 1987. These realizations have the significant advantage of eliminating the most expensive part of the filters, i.e., the coupling irises, and replacing each iris with a simple length of the dielectric resonant enclosure and a pair of tuning screws. The dielectric resonators are coupled through evanescent (cutoff) fields existing in the section in the enclosure. Although extremely attractive from a production point of view, this realization has the disadvantage that the filter becomes excessively long, especially if small couplings are needed in the narrow-bandwidth filters.

SUMMARY

The object of this invention is to provide coupling means between adjacent resonators at microwave frequencies. Another object of this invention is to implement highly selective bandpass filters. Still another object of this invention is to provide coupling means between any two dual-mode cavities without irises. A further object of this invention is to provide means for adjustment of the coupling between the resonators. Still further object of this invention is to provide a practical, flexible and economical means of replacing the irises, and of reducing the length of the coupling structure.

These objects are achieved by coupling two adjacent cavities through a short section of waveguide in an evanescent mode, which has a cutoff frequency beyond the passband of the bandpass filter. The section can be shaped to control the coupling. Tuning screws may be inserted in this coupling section to adjust the coupling between the two adjacent cavities.

BRIEF DESCRIPTION OF THE DRAWINGS

FIG. 1(*a*) shows a prior art to couple two cavities in $TE_{1n}$ mode through an iris. Input and output ports are coaxial probes.

FIG. 1(*b*) shows a prior art to couple two cavities in $TE_{1n}$ mode through an iris. Input and output parts are iris to waveguides.

FIG. 1(*c*) shows a prior art to couple two cavities loaded with dielectric resonators through an iris.

FIG. 1(*d*) shows a prior art to couple two cavities loaded with dielectric resonators through a circular iris. (Canonical form)

FIG. 1(*e*) shows a prior art to couple two empty cavities through a circular iris. (Canonical form)

FIG. 1(*f*) shows a prior art to couple two cavities loaded with dielectric resonators and with tuning screws placed between the two resonators to adjust the coupling.

FIG. 3(*a*) shows the structure of the circular coupling section between two cavities loaded with dielectric resonators according to this invention.

FIG. 3(*b*) shows the structure of the circular coupling section between two empty cavities according to this invention.

FIG. 3(*c*) shows the structure of a rectangular coupling section between two circular cavities loaded with dielectric resonators according to this invention.

FIG. 3(*d*) shows the structure of a rectangular coupling section between two circular empty cavities according to this invention.

FIG. 3(*e*) shows the structure of a rectangular coupling section between two rectangular cavities loaded with dielectric resonators according to this invention.

FIG. 3(*f*) shows the structure of a rectangular coupling section between two empty rectangular cavities according to this invention.

FIG. 4(*a*) shows the screw arrangement for adjusting the coupling of the coupling section.

FIG. 4(*b*) shows the equivalent circuit of the coupling section.

DETAILED DESCRIPTION OF THE PREFERRED EMBODIMENT

As explained in the afore-mentioned Atia and William's paper, the dual-mode filters make use of the orthogonal relationship of the excited degenerate mode fields to effectively increase the number of resonant sections. Thus, with two resonant cavities, a four pole filter can be effected with dual-mode filter, while only a two pole filter can be achieved with single-mode filter.

Figure 2:
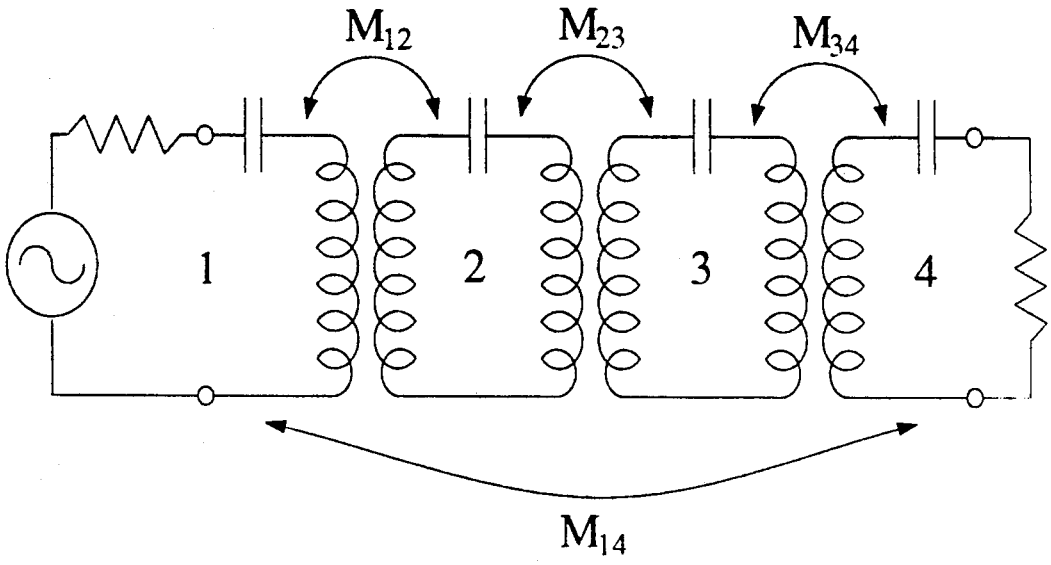
Fig.2 Prior Art
FIG. 2 shows the equivalent circuit of the filters shown in FIG. 1(*a*) through FIG. 1(*f*).

FIG. 1(*a*) through FIG. 1(*f*) show the common methods of coupling two dual-mode circular waveguide cavities to form a four pole filter. In these figures, the arrowheads F1, F2, F3, F4 indicate the electric fields, which are paired with one another as orthogonal pairs in polarization. The equivalent circuit for such a filter is shown in FIG. 2, where four resonant circuits are coupled, resulting in a four pole filter. Resonant circuits 1, 2, 3 and 4 in FIG. 2 correspond to modes F1, F2, F3 and F4 in FIGS. 1(*a*) to 1(*f*) respectively.

In these figures, there are two waveguide cavities 10 and 11, separated through an electric wall 12 between the two cavities. On the wall are irises 7 for coupling between the two cavities.

In FIG. 1(*a*), the incoming signal is excited by the probe 8, inserted in the waveguide cavity 10. The excited electric field as indicated by the arrowhead F1 is split into an orthogonal field F2 by means of a screw 5, placed diagonally at 45 degrees with respect to the input probe direction 8. The resonant frequencies of the orthogonal fields F1 and F2 can be adjusted individually by the two tuning screws 1 and 2, which are placed parallel to the two orthogonal fields F1 and F2. Similarly, the output cavity 11 has corresponding tuning screws 3 and 4 to adjust the resonant frequencies of the orthogonal fields F3 and F4 and a diagonal screw 6 to couple the two orthogonal fields for outputting the filtered signal at the probe 9. FIG. 1(*b*) is similar to FIG. 1(*a*), except that signal is excited from a slot 8 and outputting from a slot 9.

In FIG. 1(*a*) and FIG. 1(*b*), there are two thin cross irises 7 in the wall 12, which provide the required couplings M14 and M23 of the equivalent circuit of FIG. 2, through the magnetic fields of the degenerate modes in each cavities. The lengths of the horizontal and vertical slots can be independently chosen to achieve any values of the two couplings.

In FIG. 1(*c*), the cavities 10 and 11 can be considerably shortened and reduced in diameter by placing dielectric resonators 13 and 14 in respective cavities. Because of the high dielectric constants of the dielectric resonators, the dimensions of the resonators, hence the cavities, can be reduced in size as compared with that in FIG. 1(*a*) and FIG. 1(*b*).

In FIG. 1(*d*), the thin cross irises of FIG. 1(*c*) is replaced by a circular iris 15 which is easier to fabricate. In FIG. 1(*e*), the cross iris of FIG. 1(*a*) is replaced by a circular iris for the same reason.

In FIG. 1(*f*), the couplings between the two dual mode dielectric resonators 13 and 14 are achieved through the evanescent mode fields in the enclosure by adjusting the resonators spacing S. To achieve unequal couplings among the modes, the two pairs of tuning screws 101 and 102 placed symmetrically midway between the two resonators are used.

The coupling method of FIG. 1(*f*) is not suitable for the empty cavity case, since the connecting guide between the two cavities supports propagating modes of the resonant frequencies of the cavities. In this device, a new coupling method as shown in FIG. 3(*a*) through FIG. 3(*f*) introduces a short section of an evanescent mode waveguide to couple the two dual mode cavities.

In FIG. 3(*a*), two cavities 101 and 102 are coupled through a short section 301 of an evanescent mode waveguide. Each of the cavities is excited by a pair of degenerate in hybrid modes $HE_{1n}$. The section 301 has a pair of screws 401 and 402 that can be moved into and out of the coupling waveguide section, to control the values of the coupling between the first resonant modes, F1, F2 to the second resonant resonant modes F3, F4.

The equivalent circuit of the coupling structure between two resonant modes are shown in FIG. 4(*b*). In this figure, M is the mutual coupling between the two resonant circuits representing the resonators, L is the self inductance of each resonator, k is the coupling coefficient between the resonator defined as the ratio (M/L). The equivalent circuit is symmetrical about the plane A—A shown in FIG. 4(*b*). There are two resonant frequencies that can be defined for the coupling structure: (i) resonant frequency fe which is the resonant frequency of one resonator when a perfect electric wall (a short circuit) is placed along the plane A—A; and (ii) resonant frequency fm which is the resonant frequency of one resonator when a perfect magnetic wall (an open circuit) is placed along the plane A—A. From the frequencies fe and fm, the coupling coefficient k can be calculated to be:

$$k = \frac{M}{L} = \frac{fe^2 - fm^2}{fe^2 + fm^2}$$

The two pairs of screws X—X and Y—Y shown in FIG. 4(*a*) affect the electric fields of the two orthogonal dual modes in cases when magnetic wall exists in the symmetry plane A—A, but have no, or negligible, effects on any fields in the cases when an electric wall exists in the symmetry plane A—A. Furthermore, the effect of inserting these screws deeper into the cavities is to lower the value of fm, leaving fe unchanged. Therefore, inserting these screws deeper into the evanescent mode waveguide section has the effect of increasing the coupling coefficient between the corresponding modes. Thus, the new coupling mechanism controls the values of the coupling between the dual modes in each of the cavities independently by proper adjustment of the penetration of the screws into the cavities.

The equivalent circuit of the four pole, dual mode, empty waveguide filter can also be represented by FIG. 2. The modes existing in each of the two cavities are in a combination of normal circular waveguide modes. The pair of coupling screws 401 (in FIG. 3(*a*) or FIG. 3(*b*)) are introduced to adjust the coupling M23. This configuration allows limited adjustment of the ratio between coupling M14 and coupling M23.

FIG. 3(*a*) shows a four pole dual hybrid mode dielectric resonator filter. The filter is similar to the empty waveguide filter shown in FIG. 3(*b*). Each enclosure contains a dielectric resonator 201 and 202 coaxially placed inside the corresponding enclosure 101 and 102 respectively. Section 301 connects the two enclosures 101 and 102 similar to that of the four pole, dual mode empty waveguide filter shown in FIG. 3(*b*). Except for the reduced dimension, the operation is also similar.

To avoid using tuning screws and to have any independent arbitrary values of M14 and M23, the coupling section 301 of FIG. 3(*c*) with dielectric resonators and FIG. 3(*d*) with empty waveguide is introduced. The coupling section is rectangular and therefore allows the coupling to be independently determined by the dimensionals a and b of the cut-off waveguide section.

The filters in FIG. 3(*e*) and FIG. 3(*f*) are dual mode dielectric loaded and empty rectangular waveguide filters respectively. The empty waveguide filter of FIG. 3(*f*) consists of two rectangular waveguide sections 101 and 102 coupled by a small rectangular evanescent mode waveguide section 301. Coupling screws 201 and 202 are provided, at a 45 degree angle to the directions of the electric fields of the modes, to couple resonant modes F1, F2 and F3, F4 in the resonators 101 and 102 respectively. The dimensions a and b of the cavities 101 and 102 cross sections are chosen such that the two orthogonal modes resonate at the same frequency, without the need for tuning screws. To accomplish this, the effects of loading of the input and output coaxial probes 401 and 402, the coupling section 301 and the coupling screws 201 and 202 must all be accounted for. Ability to design filters with no tuning screws is advantageous to reduce the losses and eliminate the need for tuning.

Dimension c and d of the coupling evanescent mode section 301 can be computed to provide the required coupling M23 and M14. The dielectric loaded filter of FIG. 3(*e*) takes advantage of the same principles described above for the empty filter of FIG. 3(*f*). The dielectric resonators in FIG. 3(*e*) can also be cylindrical as shown or rectangular.

Figure 5:
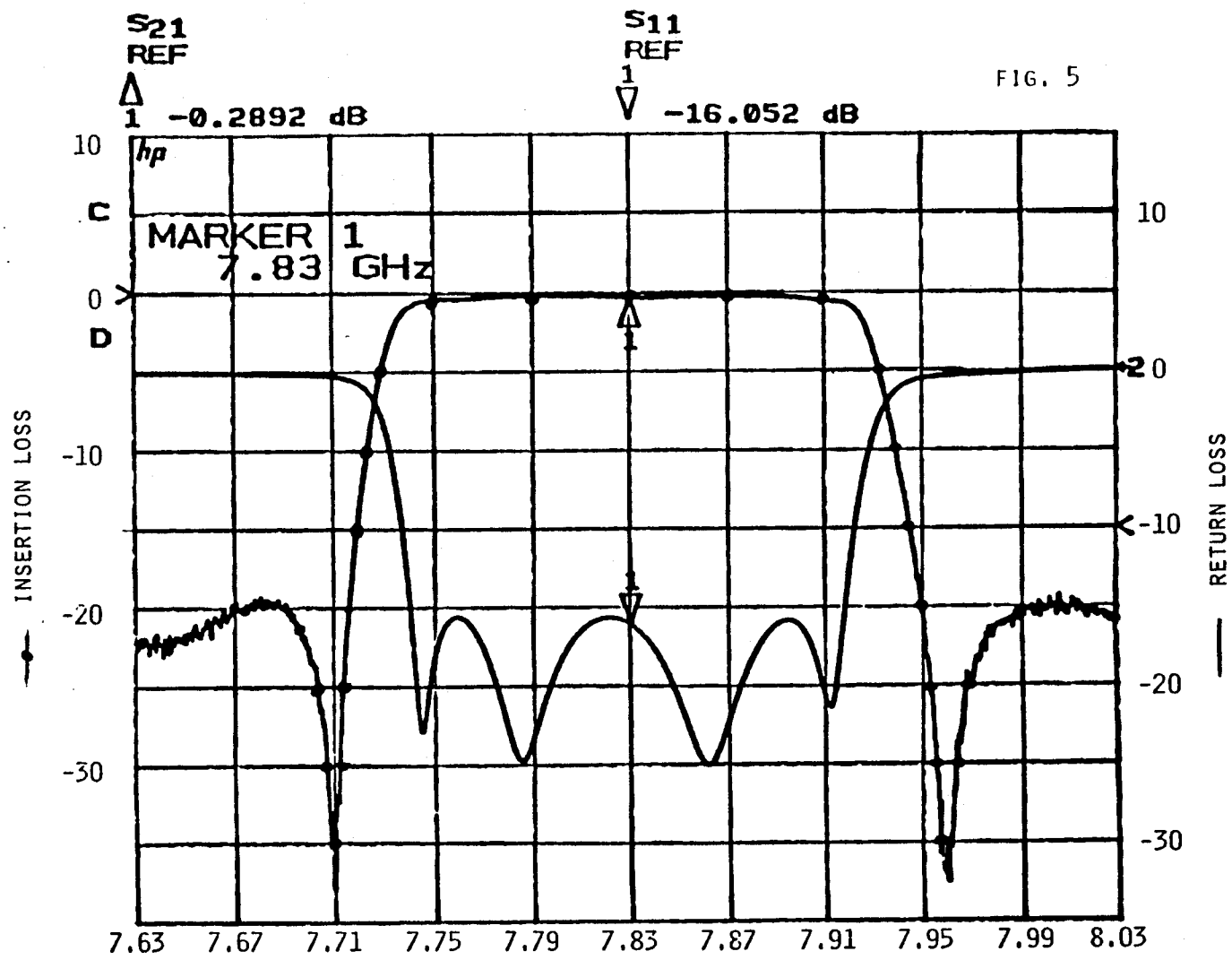
FIG. 5 shows the measured insertion and return loss of an experimental filter using the coupling means of this invention.

Experimental verification of the concepts introduced above has been made by constructing a 4-pole filter and measuring its performance. The measured results are shown in FIG. 5.

What is claimed is:

1. A dual-mode bandpass filter, comprising:

a first cavity resonator and a second cavity resonator, each said cavity resonator having a length of waveguide closed at one end by a conducting end plane and partially open at other end, and supporting two degenerate independent orthogonal modes of electromagnetic fields, each of said two modes in said first cavity resonator and each of said two modes in said second cavity resonator representable by a tuned circuit for a total of four tuned circuits, a short waveguide coupling section shorter than said length of waveguide, having a cross-section smaller than the cross-sections of said first cavity resonator and said second cavity resonator, connecting said partially open end of said first cavity resonator and said partially open end of said second cavity resonator, providing coupling among each of the two degenerate orthogonal modes in said first cavity resonator to each of the two degenerate orthogonal modes in said second cavity resonator of said tuned circuits, and representing and operating in an evanescent mode with a cutoff frequency higher than the resonant frequencies of each of said four tuned circuits.

2. A dual-mode bandpass filter as described in claim 1, wherein said cavity resonators are empty waveguides.

3. A dual-mode bandpass filter as described in claim 1, wherein said cavity resonators are dielectric resonators embedded in respective enclosures, with said short waveguide coupling section joining said enclosures.

4. A dual-mode bandpass filter as described in claim 1, wherein said short waveguide coupling section has a circular cross-section.

5. A dual-mode bandpass filter as described in claim 4, wherein screws are inserted into said short waveguide coupling section to adjust the coupling between two said cavity resonators.

6. A dual-mode bandpass filter as described in claim 2, wherein said empty waveguides have a circular cross-section and said coupling section has a rectangular cross-section.

7. A dual-mode bandpass filter as described in claim 6, wherein said coupling section has horizontal and vertical dimensions chosen such that said two orthogonal modes resonate at the same frequency.

8. A dual-mode bandpass filter as described in claim 3, wherein said enclosures have a circular cross-section and said coupling section has a rectangular cross-section.

9. A dual-mode bandpass filter as described in claim 8, wherein said coupling section has horizontal and vertical dimensions chosen such that said two orthogonal modes resonate at the same frequency.

10. A dual-mode bandpass filter as described in claim 2, wherein said empty waveguides have rectangular cross-sections.

11. A dual-mode bandpass filter as described in claim 10, wherein said coupling section has a rectangular cross-section.

12. A dual-mode bandpass filter as described in claim 3, wherein said enclosures have rectangular cross-sections and said coupling section has a rectangular cross-section.

* * * * *